US011473239B2

(12) United States Patent
Wang

(10) Patent No.: US 11,473,239 B2
(45) Date of Patent: Oct. 18, 2022

(54) METHOD FOR DYEING AND REMOVING COLORED IMPURITIES

(71) Applicant: CHAEI HSIN ENTERPRISE CO., LTD., Taichung (TW)

(72) Inventor: Shui-Mu Wang, Taichung (TW)

(73) Assignee: CHAEI HSIN ENTERPRISE CO., LTD., Taichung (TW)

( * ) Notice: Subject to any disclaimer, the term of this patent is extended or adjusted under 35 U.S.C. 154(b) by 280 days.

(21) Appl. No.: 16/921,260

(22) Filed: Jul. 6, 2020

(65) Prior Publication Data

US 2021/0277597 A1 Sep. 9, 2021

(30) Foreign Application Priority Data

Mar. 6, 2020 (TW) ..... 109107476

(51) Int. Cl.

| | |
|---|---|
| ***D06P 7/00*** | (2006.01) |
| ***D06P 1/00*** | (2006.01) |
| ***D06B 1/02*** | (2006.01) |
| ***D06B 19/00*** | (2006.01) |
| ***D06P 3/52*** | (2006.01) |
| ***D06P 5/20*** | (2006.01) |
| ***D06P 5/08*** | (2006.01) |
| ***D06P 5/00*** | (2006.01) |
| ***D06B 21/00*** | (2006.01) |

(52) U.S. Cl.

CPC ..... *D06P 7/005* (2013.01); *D06B 1/02* (2013.01); *D06B 19/0076* (2013.01); *D06B 21/00* (2013.01); *D06P 1/0016* (2013.01); *D06P 3/52* (2013.01); *D06P 5/002* (2013.01); *D06P 5/08* (2013.01); *D06P 5/2077* (2013.01)

(58) Field of Classification Search

CPC ..... D06P 7/005; D06P 1/0016; D06P 3/52; D06P 5/002; D06P 5/08; D06P 5/2077; D06B 1/02; D06B 19/0076; D06B 21/00

See application file for complete search history.

(56) References Cited

U.S. PATENT DOCUMENTS

| | | | | |
|---|---|---|---|---|
| 3,716,330 | A * | 2/1973 | Kitamura | C09B 67/0071 8/933 |
| 5,210,915 | A * | 5/1993 | Clarke | A44B 11/2523 24/641 |
| 2016/0177112 | A1* | 6/2016 | Sakaguchi | C09D 11/54 252/183.11 |
| 2020/0238655 | A1* | 7/2020 | Hattori | D06N 3/0065 |

FOREIGN PATENT DOCUMENTS

| | | | | |
|---|---|---|---|---|
| DE | 3229194 | * | 2/1984 | D06B 9/04 |
| GB | 2213842 | * | 12/1987 | D06L 3/00 |
| WO | WO2019069613 | * | 11/2004 | B32B 27/20 |

OTHER PUBLICATIONS

Derwent 2015-619810, 2016.*

* cited by examiner

*Primary Examiner* — Amina S Khan
(74) *Attorney, Agent, or Firm* — Ladas & Parry, LLP

(57) ABSTRACT

Disclosed herein is a method for dyeing and removing colored impurities, which includes providing a polyester fabric and an adsorption material, spraying a coloring material onto a surface of the polyester fabric to form a colored layer, subjecting the polyester fabric thus dyed to a heating treatment for the colored layer to adhere to the surface of the polyester fabric, attaching or applying the adsorption material onto the colored layer and subsequently heating and/or applying a pressure to the adsorption material so that the adsorption material is coated on the colored layer to adsorb colored impurities therefrom, and removing the adsorption material.

4 Claims, 5 Drawing Sheets

METHOD FOR DYEING AND REMOVING COLORED IMPURITIES

CROSS-REFERENCE TO RELATED APPLICATION

This application claims priority of Taiwanese Patent Application No. 109107476, filed on Mar. 6, 2020.

FIELD

The present disclosure relates to a method for dyeing and removing colored impurities.

BACKGROUND

Polyester is strong in strength, light in weight, high in hydrophobicity, and low in moisture regain, and has excellent plastic memory characteristics. Polyester is crease-resistant and quick-drying, retains its shape in garments, is abrasion-resistant, and requires minimum care. Fabrics made of polyester multifilaments are in wide use as various cloth materials for sportswear, casual wear, coats and the like or as clothes such as down-proof fabrics, and umbrella cloths.

Since polyesters are liable to a high degree of densification, have great crystallinity, and lack a reactive group, polyester fabric is difficult to dye. There are many dyeing or printing methods for applying a decorative pattern on the surface of a polyester fabric, and one of the most cost-effective methods of dyeing a polyester fabric is spray dyeing. Spray dyeing includes conventional spraying as well as atomization and electrostatic applications. With most spray dyeing methods, the redundant polymer and excess dye must be removed by washing with water after the fixation of the print. Generally, a large amount of water is required for complete removal of excess dye due to the risk of back-staining during the process, i.e., redeposit on the fabric of already dissolved dye. This will cause an appreciable amount of liquid waste containing pollutants.

In view of the foregoing, the applicant attempted to develop a more efficient and also more environmentally friendly method for removing colored impurities.

SUMMARY

Accordingly, in a first aspect, the present disclosure provides a method for dyeing and removing colored impurities, which includes:

a) providing a polyester fabric and an adsorption material that is non-viscous and ductile at room temperature;

b) spraying a coloring material onto a surface of the polyester fabric to form a colored layer on the surface of the polyester fabric, so as to dye the polyester fabric;

c) subjecting the polyester fabric thus dyed to a heating treatment, so that the colored layer adheres to the surface of the polyester fabric, the colored layer containing colored impurities;

d) attaching the adsorption material onto the colored layer, followed by heating and applying a pressure to the adsorption material, so that the adsorption material is softened and coated on the colored layer, and the colored impurities in the colored layer are adsorbed by the adsorption material; and e) removing the adsorption material, In a second aspect, the present disclosure provides a method for dyeing and removing colored impurities, which includes:

a) providing a polyester fabric and an adsorption material which is in the form of one of a liquid and a slurry at room temperature;

b) spraying a coloring material onto a surface of the polyester fabric to form a colored layer on the surface of the polyester fabric, so as to dye the polyester fabric;

c) subjecting the polyester fabric thus dyed to a heating treatment, so that the colored layer adheres to the surface of the polyester fabric, the colored layer containing colored impurities;

d) applying the adsorption material onto the colored layer, followed by heating the adsorption material, so that the adsorption material is cured into a film and is coated on the colored layer, and the colored impurities in the colored layer are adsorbed by the adsorption material; and e) removing the adsorption material.

BRIEF DESCRIPTION OF THE DRAWINGS

Other features and advantages of the disclosure will become apparent in the following detailed description of the embodiments with reference to the accompanying drawings, of which.

DETAILED DESCRIPTION

It is to be understood that, if any prior art publication is referred to herein, such reference does not constitute an admission that the publication forms a part of the common general knowledge in the art, in Taiwan or any other country.

For the purpose of this specification, it will be clearly understood that the word "comprising" means "including but not limited to", and that the word "comprises" has a corresponding meaning.

Unless defined otherwise, all technical and scientific terms used herein have the meaning commonly understood by a person skilled in the art to which the present disclosure belongs. One skilled in the art will recognize many methods and materials similar or equivalent to those described herein, which could be used in the practice of the present disclosure. Indeed, the present disclosure is in no way limited to the methods and materials described.

Figure 1:
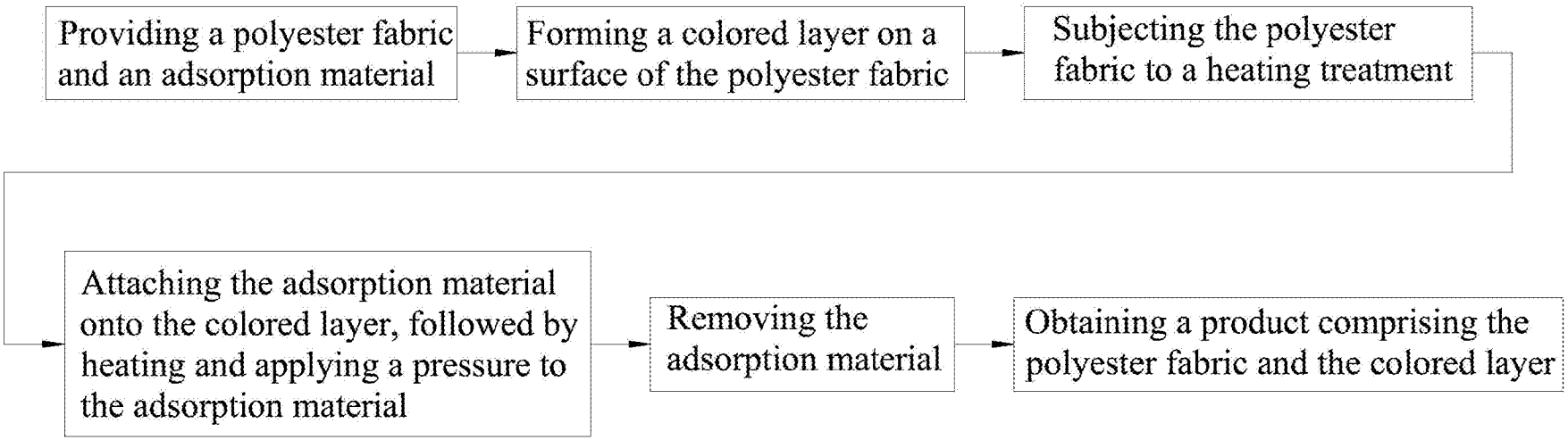
FIG. 1 is a flow chart of a first embodiment of a method for dyeing and removing colored impurities according to the present disclosure.
Figure 2:
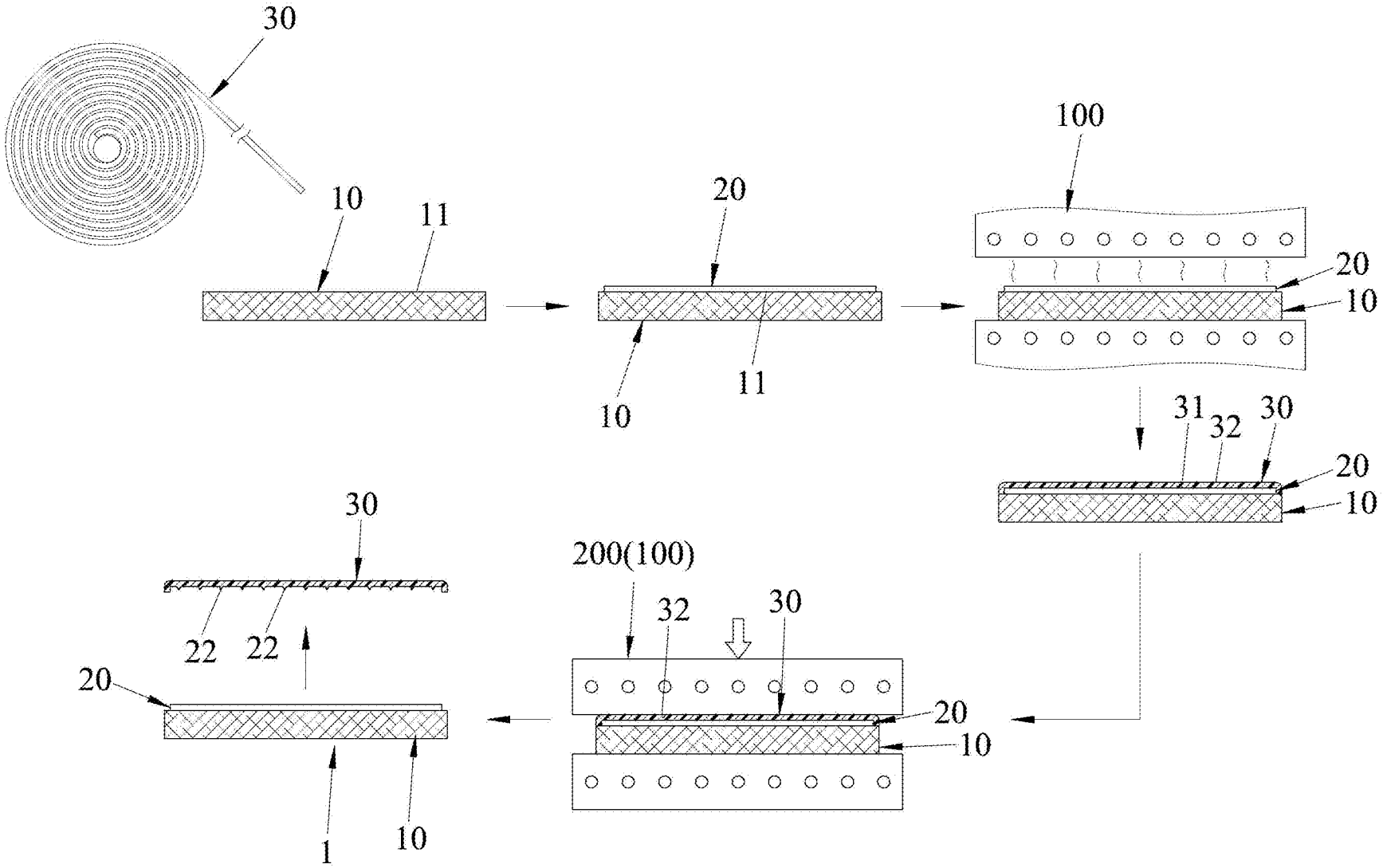
FIG. 2 is a schematic sectional view illustrating steps (a) to (e) of the first embodiment.

Referring to FIGS. 1 to 2, a first embodiment of a method for dyeing and removing colored impurities according to the present disclosure includes:

a) providing a polyester fabric 10 and an adsorption material 30 that is non-viscous and ductile at room temperature;

b) spraying a coloring material onto a surface 11 of the polyester fabric 10 to form a colored layer 20 on the surface 11 of the polyester fabric 10, so as to dye the polyester fabric 10;

c) subjecting the polyester fabric 10 thus dyed to a heating treatment, so that the colored layer 20 adheres to the surface 11 of the polyester fabric 10, the colored layer 20 containing colored impurities 22;

d) attaching the adsorption material 30 onto the colored layer 20, followed by heating and applying a pressure to the adsorption material 30, so that the adsorption material 30 is softened and coated on the colored layer 20, and the colored impurities 22 in the colored layer 20 are adsorbed by the adsorption material 30; and e) removing the adsorption material 30.

According to the present disclosure, the polyester fabric 10 may be made of a polyester fiber, or may be made by blending the polyester fiber with a fabric material.

According to the present disclosure, the polyester fabric 10 may be made by methods well known in the art, including but not limited to knitting and weaving (e.g., non-woven weaving and plain weaving).

According to the present disclosure, the fabric material may be selected from the group consisting of cotton, linen, silk, nylon, rayon, a chemical fiber other than the aforesaid chemical fibers, a natural fiber other than the aforesaid natural fibers, and combinations thereof.

In step (a) of this embodiment, the adsorption material 30 is in the form of a film, and may be selected from the group consisting of nylon, polyvinylchloride (PVC), thermoplastic polyurethane (TPU), polyurethane (PU), ethylene-vinyl acetate (EVA) copolymer, polycarbonate (PC), polymethylmethacrylate (PMMA), an acrylic resin, and combinations thereof.

According to the present disclosure, the adsorption material 30 in the form of a film has an inner surface 31 that is attached to the colored layer 20, and an outer surface 32 that is opposite to the inner surface 31.

According to the present disclosure, the heating treatment in step (c) and the heating in step (d) are conducted using a heating equipment 100 (such as an oven).

In step (a) of this embodiment, the adsorption material 30 in the form of a film is coiled in a roll, which. is to be rolled out and overlaid on the colored layer 20 in step (d) of this embodiment.

In step (d) of this embodiment, a positive pressure is applied to the outer surface 32 of the adsorption material 30 using a pressurizer 200 equipped with the heating equipment 100.

In step (d) of this embodiment, after heating and applying a pressure to the adsorption material 30, the adsorption material 30 is softened and coated on the colored layer 20, and may partially permeate into the colored layer 20.

Figure 3:
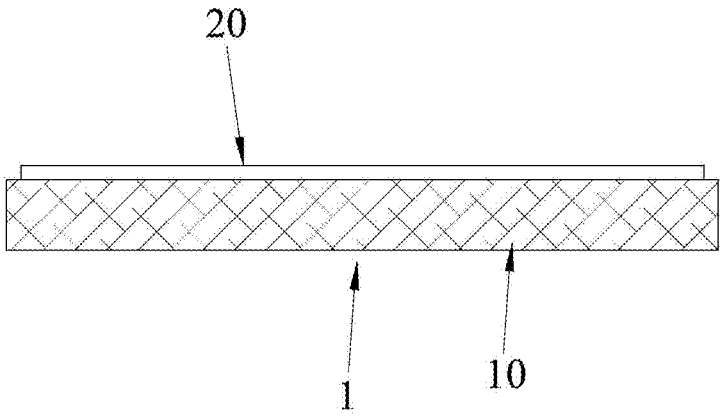
FIG. 3 is a schematic sectional view illustrating a product obtained using the first embodiment.

FIG. 3 illustrates that a product 1 is obtained after the colored impurities 22 have been removed using the method of the present disclosure.

Figure 4:
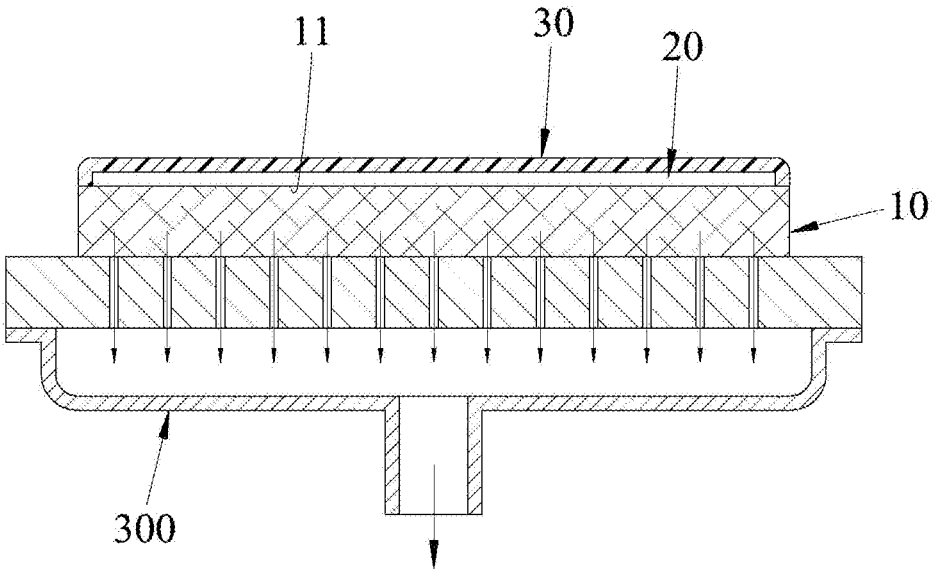
FIG. 4 is a schematic sectional view illustrating step (d) of a second embodiment of the method according to the present disclosure.

FIG. 4 illustrates a second embodiment of the method according to the present disclosure. The second embodiment differs from the first embodiment in that, in step (d) of the method, a negative pressure is applied to the adsorption material 30 using a vacuumizer 300, so that a suction force is produced on the surface 11 of the polyester fabric 10.

Figure 5:
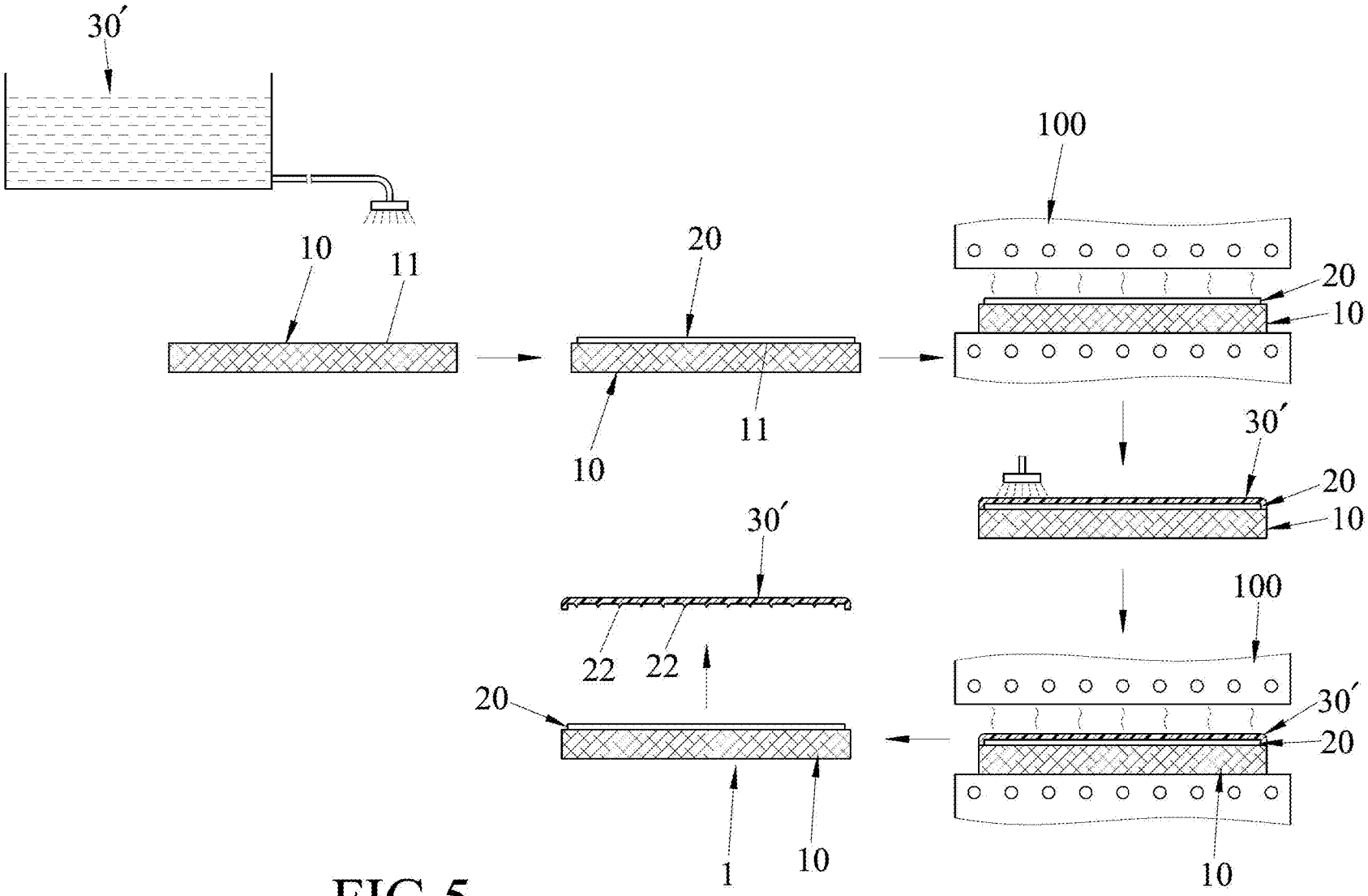
FIG. 5 is a schematic sectional view illustrating steps (a) to (e) of a third embodiment of the method according to the present disclosure.

Referring to FIG. 5, a third embodiment of the method according to the present disclosure includes:

a) providing a polyester fabric 10 and an adsorption material 30' which is in the form of a liquid or a slurry at room temperature;

b) spraying a coloring material onto a surface 11 of the polyester fabric 10 to form a colored layer 20 on the surface 11 of the polyester fabric 10, so as to dye the polyester fabric 10;

c) subjecting the polyester fabric 10 thus dyed to a heating treatment, so that the colored layer 20 adheres to the surface 11 of the polyester fabric 10, the colored layer 20 containing colored impurities 22;

d) applying the adsorption material 30' onto the colored layer 20, followed by heating the adsorption material 30', so that the adsorption material 30' is cured into a film and is coated on the colored layer 20, and the colored impurities 22 in the colored layer 20 are adsorbed by the adsorption material 30'; and e) removing the adsorption material 30'.

The first and third embodiments differ from each other only in the form of the adsorption material 30, 30' provided in step (a) and the approach to coat the the adsorption material 30, 30' on the colored layer 20 in step (d) Nevertheless, the strategy that aims to coat the adsorption material 30, 30' on the colored layer 20 is the same in the first and third embodiments.

In addition, in step (a) of the third embodiment, the adsorption material 30' may be selected from the group consisting of nylon, polyvinylchloride (PVC), thermoplastic polyurethane (TPU), polyurethane (PU), ethylene-vinyl acetate (EVA) copolymer, polycarbonate (PC), polymethylmethacrylate (PMMA), an acrylic resin, an ester, and combinations thereof.

In step (d) of the third embodiment, the adsorption material 30' may be sprayed onto the colored layer 20.

In step (d) of this embodiment, after heating the adsorption material 30', the adsorption material 30' is cured into a film and is coated on the colored layer 20, and may permeate into the colored layer 20.

No matter whether the adsorption material 30, 30' is overlaid on the colored layer 20 in the form of a non-viscous film (see the first and second embodiments) or is sprayed on the colored layer 20 in the form of a liquid or a slurry (see the third embodiment), the adsorption material 30, 30' can be completely coated on the colored layer 20 after heating and/or pressurizing the adsorption material 30, 30', and hence can effectively adsorb the colored impurities 22. Therefore, the method according to the present disclosure can directly take away the colored impurities 22 by removing the adsorption material 30, 30' without water washing, thereby preventing water consumption and generation of pollutional liquid waste.

In the description above, for the purposes of explanation, numerous specific details have been set forth in order to provide a thorough understanding of the embodiments. It will be apparent, however, to one skilled in the art, that one or more other embodiments may be practiced without some of these specific details.

It should also be appreciated that reference throughout this specification to "one embodiment," "an embodiment," an embodiment with an indication of an ordinal number and so forth means that a particular feature, structure, or characteristic may be included in the practice of the disclosure . It should be further appreciated that in the description, various features are sometimes grouped together in a single embodiment, figure, or description thereof for the purpose of streamlining the disclosure and aiding in the understanding of various inventive aspects.

While the disclosure has been described in connection with what are considered the exemplary embodiments, it is understood that this disclosure is not limited to the disclosed embodiments but is intended to cover various arrangements included within the spirit and scope of the broadest interpretation so as to encompass all such modifications and equivalent arrangements.

What is claimed is:

1. A method for dyeing and removing colored impurities, comprising:

a) providing a polyester fabric and an adsorption material that is non-viscous and ductile at room temperature;

b) spraying a coloring material onto a surface of the polyester fabric to form a colored layer on the surface of the polyester fabric, so as to dye the polyester fabric;

c) subjecting the polyester fabric thus dyed to a heating treatment, so that the colored layer adheres to the surface of the polyester fabric, the colored layer containing colored impurities;

d) attaching the adsorption material onto the colored layer, followed by heating and applying a pressure to the adsorption material, so that the adsorption material is softened and coated on the colored layer, and the colored impurities in the colored layer are adsorbed by the adsorption material; and e) removing the adsorption material.

2. The method according to claim 1, wherein in step (a), the, adsorption material is in the form of a film, and is selected from the group consisting of nylon, polyvinylchloride (PVC), thermoplastic polyurethane (TPU), polyurethane (PU), ethylene-vinyl acetate (EVA) copolymer, polycarbonate (PC), polymethylmethacrylate (PMMA), an acrylic resin, and combinations thereof.

3. The method according to claim 2, wherein in step (a), the adsorption material in the form of a film is coiled in a roll.

4. The method according to claim 1, wherein in step (d), the pressure applied to the adsorption material is one of a positive pressure and a negative pressure.

* * * * *